US005247771A

United States Patent [19]

Poplin

[11] Patent Number: 5,247,771

[45] Date of Patent: Sep. 28, 1993

[54] RIDGE SHINGLE UNIT

[76] Inventor: James E. Poplin, 8671 N. Maple Ave., Fresno, Calif. 93720

[21] Appl. No.: 856,124

[22] Filed: Mar. 23, 1992

[51] Int. Cl.[5] ..... E04D 1/30

[52] U.S. Cl. ..... 52/518; 52/555; 52/560

[58] Field of Search ..... 52/57, 528, 560, 530, 52/518, 555

[56] References Cited

U.S. PATENT DOCUMENTS

| | | | |
|---|---|---|---|
| 3,913,294 | 10/1975 | Freiborg | 52/560 |
| 4,187,650 | 2/1980 | Poplin . | |
| 4,404,783 | 9/1983 | Freiborg | 52/528 |
| 4,434,589 | 3/1984 | Freiborg . | |
| 4,439,955 | 4/1984 | Freiborg | 52/57 |

FOREIGN PATENT DOCUMENTS

| | | | |
|---|---|---|---|
| 568407 | 1/1959 | Canada | 52/560 |

*Primary Examiner*—Carl D. Friedman
*Assistant Examiner*—Christopher T. Kent
*Attorney, Agent, or Firm*—Baker & Botts

[57] ABSTRACT

A ridge shingle unit is disclosed which provides for multilayer coverage of a ridge or hip of a structure. A single sheet of roofing material is cut to a shape having end portions, tapered portions, and a center portion. The sheet is folded back on itself three times in the center portion to provide a multilayered, folded ridge shingle unit. The ridge shingle units are then applied overlappingly to the ridge or hip of a structure.

10 Claims, 2 Drawing Sheets

RIDGE SHINGLE UNIT

BACKGROUND OF THE INVENTION

1. Field of the Invention

The present invention relates to a ridge shingle unit used to cover the hip and crown connections on the pitched roofs of houses, buildings, or other structures.

2. Description of the Related Art

Ridge shingle units are used by roofers to cover the ridges and hips of various structures. As such, a ridge shingle unit differs from a shingle in that it is designed for application only on the ridge and crown connections of a roof. Among other disadvantages, prior art ridge shingle units are insufficiently rigid to provide a long useful life. Thus, they do not lie flat on the roof and tend to be blown back by the wind. As a result, the underlying construction materials become damaged due to exposure.

SUMMARY OF THE INVENTION

The present invention overcomes the problems in the prior art by providing a ridge shingle unit with a layered construction that maintains its rigidity. Therefore, it is less susceptible to being blown back by strong gusts of wind and has a longer useful life. In addition, the present invention has an appealing shake-like appearance when in place on the ridge or hip of a roof. Furthermore, the tapered periphery of the present invention permits a margin of error in application so that a pleasing contour is achieved without strict adherence to a straight line. Thus, the ridge shingle unit of the present invention is easy to apply, provides a thicker, sturdier coverage that is wind resistant and has longer life than conventional ridge units, and has an pleasing appearance, among other advantages.

BRIEF DESCRIPTION OF THE DRAWINGS

A more complete appreciation of the present invention and the many attendant advantages thereof will be readily obtained as the invention becomes better understood by reference to the following detailed description when considered in connection with the accompanying drawings.

DETAILED DESCRIPTION OF THE PREFERRED EMBODIMENTS

Figure 1:
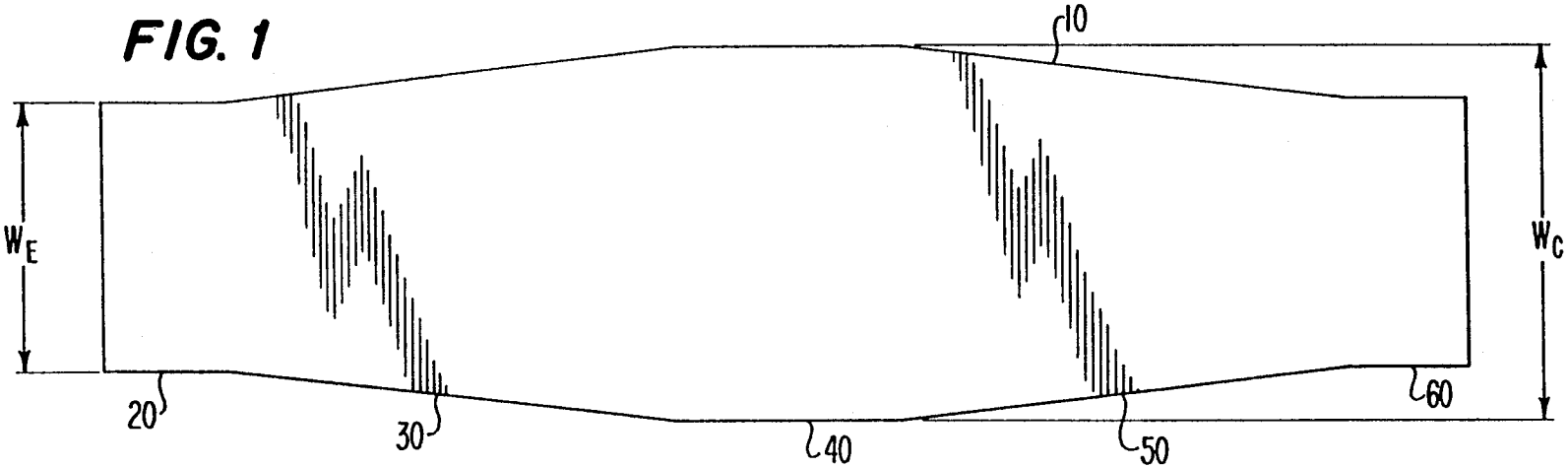
FIG. 1 illustrates the an unfolded ridge shingle unit from above.
Figure 2:
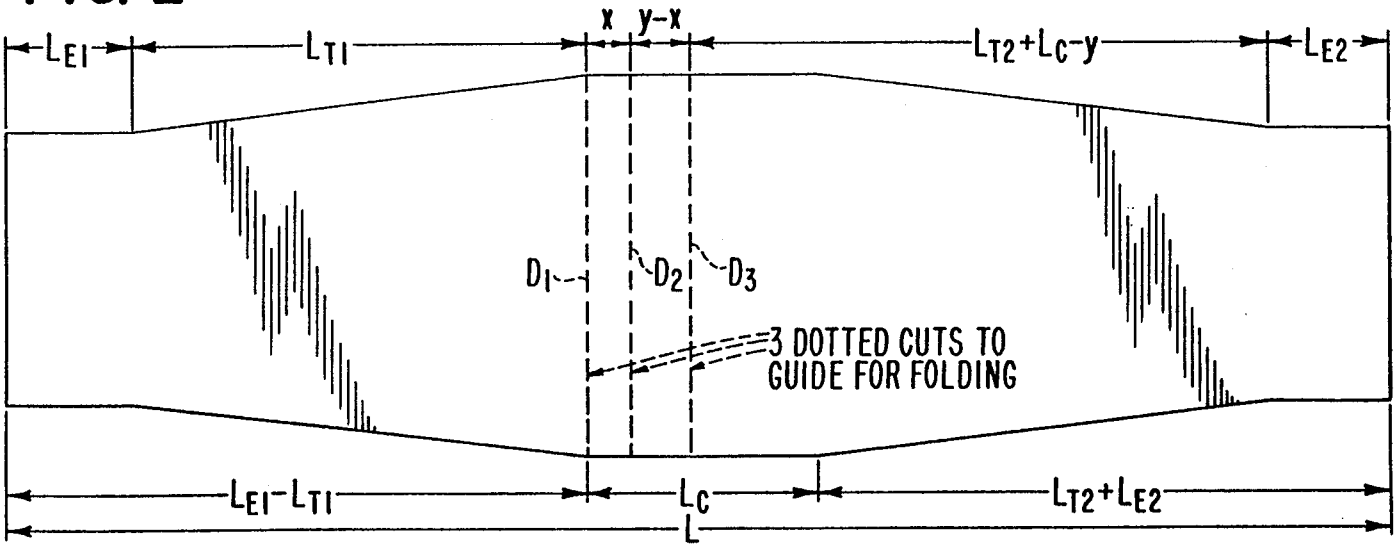
FIG. 2 illustrates the positioning of the fold lines on the unfolded ridge shingle unit.

Referring to FIGS. 1 and 2, a ridge shingle unit 10 of the present invention is depicted. The ridge shingle unit 10 is cut from a roll of commercially available composition roofing material, typically fiberglass, asphalt, or similar material. Each ridge shingle unit 10 has a length L. In a preferred embodiment, L is approximately 25 inches, however the invention is not limited in this respect. The ridge shingle unit 10 includes five portions: a first end portion 20, a first tapered portion 30, a center portion 40, a second tapered portion 50, and a second end portion 60.

The center portion 40 has a width $W_C$ which is greater than the width $W_E$ of the first and second end portions 20 and 60. The width of the tapered portions 30 and 50 decreases from a maximum of $W_C$ near the center portion 40 to a minimum of $W_E$ near the end portions 20 and 60. The end portions 20 and 60 have lengths of $L_{E1}$ and $L_{E2}$ respectively. The tapered portions 30 and 50 have lengths of $L_{T1}$ and $L_{T2}$ respectively. The length of the center portion is $L_C$.

In a preferred embodiment, $W_C$ is about $6\frac{7}{8}$ inches and $W_E$ is about $4\frac{7}{8}$ inches. The widths of the tapered portions 30 and 50 decrease linearly from about $6\frac{7}{8}$ at the center portion 40 to about $4\frac{7}{8}$ inches at end portions 20 and 60. Furthermore, the total length L equals the sum of $L_{E1}$, $L_{T1}$, $L_C$, $L_{T2}$, and $L_{E2}$. The lengths of the end portions $L_{E1}$ and $L_{E2}$ both equal about 2 inches. The lengths of the tapered portions $L_{T1}$ and $L_{T2}$ equal about 8 inches. Finally, the length of the center portion $L_C$ is about 5 inches.

Three lines of dotted cuts D1, D2, and D3 are formed in the ridge unit across center portion 40. Line D1 is located transverse to the longitudinal axis of the ridge unit approximately between center portion 40 and tapered portion 30. Line D2 is located in center portion 40 substantially parallel to and a distance x from D1. Line D3 is located a distance y from line D1 and substantially parallel to both D1 and D2. The lines D1, D2, and D3 are formed to facilitate folding of the ridge unit 10 into final form for application. In addition, the unit may be heated to facilitate folding. As is clear to one of skill in the art, the lines D, D2, and D3 may alternatively be formed, for example, by scoring the ridge unit. However, the unit may be folded without making any cuts at all. Folding may be facilitated by heating, or any other known method or combination of known methods.

Figure 3:
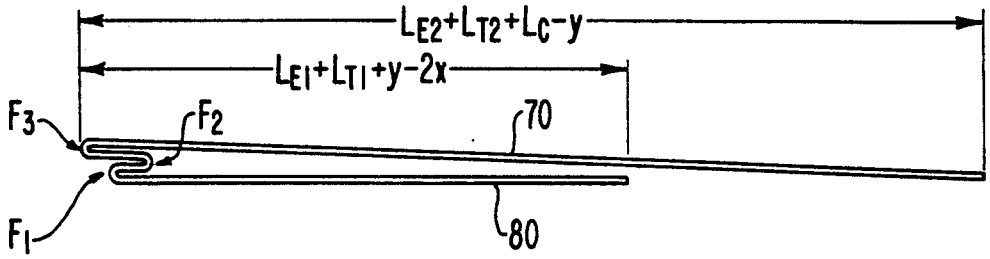
FIG. 3 illustrates a lateral view of a folded ridge shingle unit.
Figure 4:
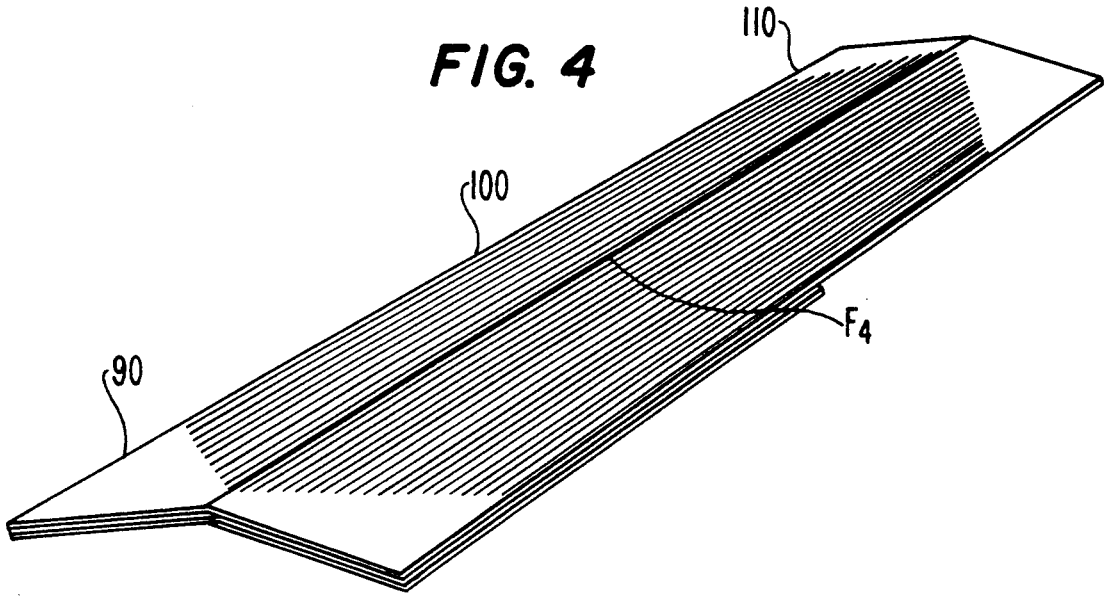
FIG. 4 illustrates a perspective view of a folded ridge shingle unit.

Referring to FIGS. 2 and 3, three folds F1, F2, and F3 of approximately 180° are made along the three dotted lines D1, D2, and D3 respectively. The first fold Fl is made along line D1, i.e., transverse to a longitudinal axis of the ridge unit in the region between center portion 40 and tapered portion 30. The second fold F2 is preferably made in the center portion approximately $\frac{1}{2}$ inch from and substantially parallel to the first fold (i.e., $x=\frac{1}{2}$ inch), however the invention is not limited in this respect. The third fold is made in the center portion substantially parallel to the first and second folds. The third fold is preferably separated from the second fold by a distance of about $\frac{1}{2}$ inch (i.e., y inch), however, the invention is not limited in this respect. As a result of folds F1, F2, and F3, an upper portion 70 overlaps a lower portion 80. In the preferred embodiment, the upper portion has a length equal to $L_{E2}+L_{T2}+L_C-y$, or 14 inches. The lower overlapped portion has a length of $L_{E1}+L_{T2}+y-2x$, or 10 inches.

The unit is then folded along a longitudinal axis F4 to produce an inverted "V" shaped ridge shingle unit. Therefore, the upper portion 70 of the ridge shingle unit has a thicker, wider portion 90 which corresponds to the center portion of the unfolded unit, a tapered portion 100 corresponding to a tapered portion of the unfolded unit, and an end portion 110 corresponding to the end portion of the unfolded unit. Preferably, the ridge shingle units are cut and folded at the factory in order to maintain the rigidity of the folded shape. The ready to apply, folded ridge shingle units are then distributed to the roofer.

Figure 5:
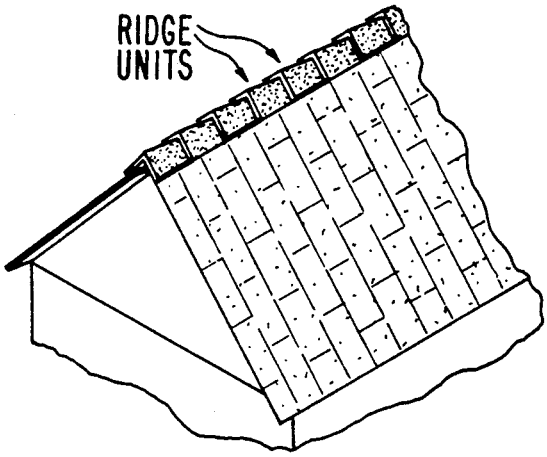
FIG. 5 illustrates a plurality of ridge shingle units in place on the ridge of a house.

The ridge shingle units are secured on the ridge of a roof in an overlapping fashion as shown in FIG. 5. One end of the ridge is covered first. Where a hip is to be covered, the lowest edge of the hip is covered first. The thicker, wider portion 90 of a first ridge shingle unit is positioned to cover the end portion of the ridge. The first ridge shingle unit is then secured to the roof by nails or other conventional means. The top of a second ridge unit is positioned a distance from the top of the first ridge unit so as to overlap the first ridge unit. In particular, an end portion 110 and a part of a tapered portion 100 of the first ridge shingle unit are covered by the second ridge shingle unit. As a result the second ridge unit covers the nails securing the first ridge unit. Further ridge units are applied in a similar fashion.

In a preferred embodiment, the top of the second ridge shingle unit is positioned approximately 10 inches from the top of the first ridge shingle unit. Thus, the thicker, wider portion 90 of the second ridge shingle unit corresponding to the center portion of the unfolded unit overlaps the end portion 110 and part of the tapered portion 100 of the first ridge shingle unit.

The invention has been described in detail in connection with the preferred embodiments. These embodiments, however, are merely for example only and the invention is not restricted thereto. It will be easily understood by those skilled in the art that other variations and modifications can easily be made within the scope of the invention as defined by the appended claims.

I claim:

1. A ridge shingle unit formed from at least one sheet of roofing material having a length and a longitudinal axis and further comprising:

a first portion capable of overlapping a preceding ridge shingle unit;

a second portion adjacent to said first portion, said second portion being tapered and capable of being substantially uncovered by a succeeding ridge shingle unit and a substantial portion of the second portion capable of not overlapping preceding a ridge shingle unit; and a third portion adjacent to said second tapered portion and capable of being overlapped by a succeeding ridge shingle unit, wherein the sheet has at least one fold transverse to the longitudinal axis so that said second tapered portion substantially overlaps said first portion and a multilayered coverage is thereby provided over substantially the length of the first and second portions.

2. The ridge shingle unit according to claim 1, wherein:

the ridge shingle unit has a longitudinal axis; and said first portion and said third portion have a periphery which is substantially parallel to the longitudinal axis.

3. The ridge shingle unit according to claim 2, further including a fold along the longitudinal axis.

4. The ridge shingle unit according to claim 1, wherein said first and third portions are rectangular.

5. The ridge shingle unit according to claim 1, wherein said first and second portions each comprise a plurality of layers of roofing material.

6. The ridge shingle unit according to claim 1, wherein said sheet further comprises a center portion wherein said first portion is tapered and extends from said center portion along the longitudinal axis, said second tapered portion extends from said center portion opposite said first tapered portion along the longitudinal axis, and said first tapered portion is folded under at least part of said second tapered portion and said center portion.

7. The ridge shingle unit according to claim 6, said sheet further comprising:

a first end portion extending from said first tapered portion; and a second end portion extending from said second tapered portion, wherein said first end portion is folded under said second tapered portion.

8. The ridge shingle unit according to claim 7, wherein said sheet further comprises:

a second fold at said center portion which is transverse to the longitudinal axis and at a first distance from the first fold at said center portion; and a third fold at said center portion which is transverse to the longitudinal axis and at a second distance from the first fold, thereby forming an upper portion comprised of a first section of said center portion, said first tapered portion, and said first end portion;

a first underlying portion formed by a second section of said center portion lying between said first fold and said second fold;

a second underlying portion formed by a third section of said center portion lying between said fold and said third fold; and a lower portion comprised of said first tapered portion and said first end portion.

9. The ridge shingle unit according to claim 1, wherein said sheet is additionally folded along the longitudinal axis.

10. The ridge shingle unit according to claim 1, wherein said first portion is tapered and said sheet comprises:

a center portion;

a second fold at said center portion which is transverse to the longitudinal axis and at a first distance from the first fold at said center portion; and a third fold at said center portion which is transverse to the longitudinal axis and at a second distance from said first fold, thereby forming an upper portion comprised of a first section of said center portion and said second tapered portion;

a first underlying portion formed by a third section of said center portion lying between said second fold and said third fold; and a lower portion comprised of said first tapered portion.

* * * * *